United States Patent [19]

Orlewicz

[11] 4,155,608

[45] May 22, 1979

[54] GUN CABINET

[76] Inventor: Marc L. Orlewicz, 7321 Amboy Rd., Dearborn Heights, Mich. 48127

[21] Appl. No.: 885,197

[22] Filed: Mar. 10, 1978

[51] Int. Cl.[2] ..... A47B 81/00; A47B 97/00; A47F 7/00

[52] U.S. Cl. ..... 312/204; 109/51; 109/68; 211/64; 220/3.6; 220/18; 248/201; 312/242

[58] Field of Search ..... 312/204, 245, 209, 242; 109/51, 68; 211/64; 248/201, 203; 220/3.6, 18

[56] References Cited

U.S. PATENT DOCUMENTS

| | | | |
|---|---|---|---|
| 1,084,837 | 1/1914 | Arnold | 109/68 |
| 1,382,837 | 6/1921 | Jurek | 109/68 |
| 2,315,746 | 4/1943 | Stewart | 220/3.6 |
| 3,684,344 | 8/1972 | Gilinger | 312/204 |
| 3,710,972 | 1/1973 | Barry | 220/3.6 |
| 3,918,782 | 11/1975 | Allmand | 312/204 |
| 4,070,074 | 1/1978 | Rohme | 312/209 |

*Primary Examiner*—Robert L. Wolfe
*Assistant Examiner*—Alex Grosz
*Attorney, Agent, or Firm*—Alex Rhodes

[57] ABSTRACT

A cabinet for the secure storage of a gun adapted to be mounted in the recess of a wall wherein an outer door of the said cabinet provides a disguised appearance of a decorative wall article. Directly behind the said outer door is a lockable transparent inner door whereby the user of the cabinet may conveniently inspect and display the contents thereof. An adjustable fixture inside of the cabinet retains the gun in a desired position and accommodates a range of styles and sizes of small guns. To allow quick access to the gun during day or night means are provided in said retention fixture for quick release of said gun and the interior of the cabinet is illuminated when the cabinet is opened.

11 Claims, 10 Drawing Figures

GUN CABINET

BACKGROUND OF THE INVENTION

Small guns are commonly stored in residences and business establishments by collectors or others for protective purposes. In some cases the guns are carelessly stored, exposing them to potential theft and mischievous use by minors. In other cases, the guns are kept in lockable storage in exposed articles of furniture or gun cabinets having transparent doors. It is obvious that locked articles of furniture and gun cabinets are attractive nuisances which provide inducements to others, thereby increasing the probability of theft or unauthorized use of the guns.

It is apparent that a cabinet for the secure storage of small guns would provide benefits. It is also apparent that to encourage the use of such a cabinet it must be attractive in appearance, allow quick access to the gun in the event of an emergency and preferrably should be capable of being located in a variety of settings.

SUMMARY OF THE INVENTION

The present invention is directed towards a gun cabinet which provides for the secure and protective storage of one or more small guns with features for quick access to the guns in the event of an emergency. A generally rectangular cabinet is constructed having dimensions whereby the cabinet can be substantially contained within the recess of a wall. An outer door, hinged at one end thereof to an edge of a housing directly behind the said door, gives the cabinet a diguised appearance of a decorative wall article, such as a framed work of art.

Directly behind the outer door is a lockable transparent inner door. The inner door prevents unauthorized access to the contents of the cabinet while allowing the user to inspect or display the contents thereof. Within the cabinet is an adjustable holding fixture which retains a stored gun in a desired position and accommodates a range of styles and sizes of small guns.

In the event of an emergency, quick access to a gun contained within the cabinet is provided by illuminating the interior of the cabinet when the outer door is opened and providing a holding fixture which allows quick release of said gun. The interior illumination of the cabinet facilitates, during night hours, the unlocking of the inner door and identification of the weapon.

It is a principal object of the present invention to reduce theft and unauthorized use of a small gun by the disguised storage of the gun in a lockable cabinet.

It is another principal object to provide immediate access to a stored gun in the event of an emergency which threatens the safety of the user or others.

Another object is to provide a convenient means for inspecting or displaying a gun in lockable storage.

Still yet another object is to provide the disguised storage of a gun behind a decorative wall article.

Still another object is to provide a cabinet which can be located in a variety of interior settings.

A further object is to provide an adjustable fixture for retaining a gun in a cabinet which can accommodate a range of styles and sizes of small guns.

The foregoing objects, along with additional objects, features, advantages and benefits of the present invention become more apparent in the ensuing description and accompanying drawings which disclose the invention in detail. A preferred embodiment is disclosed in accordance with the best mode presently contemplated in carrying out the invention. The subject matter in which an exclusive property right is claimed is set forth in each of the numbered claims at the conclusion of the description, and such subject matter is considered patentable over the prior art of which the applicant is aware, as set forth in the following Prior Art Statement.

PRIOR ART STATEMENT

A novelty search performed in connection with the present invention developed the following U.S. Pat. Nos.: 3,031,069; 3,329,278; and 3,468,427.

U.S. Pat. No. 3,031,069 discloses a gun case for the vertical mounting of a group of handguns wherein a lockable hinged cover is provided at the front portion thereof. Separate non-adjustable brackets for supporting the handguns are removable for service as gun rests.

U.S. Pat. No. 3,329,278 discloses a gun holding tray for use in a gun carrying case wherein a means for retaining guns is provided which includes a barrel clamp. The members of the barrel clamp are non-adjustable and rigid whereby the tray may be transported in a carrying case without displacement by any expectable handlings of the carrying case.

U.S. Pat. No. 3,468,427 discloses a pistol display in the form of a shadow box wherein the front portion of the case is in the form of a picture frame. A principal feature of the display is to support the pistols therein by U-members inserted into the barrels thereof so as to present the pistols with no apparent supports.

This Prior Art Statement is furnished in compliance with the applicant's duty of disclosure as defined in the Patent and Trademark Office rules for patent cases.

DESCRIPTION OF THE PREFERRED EMBODIMENT

Figure 1:
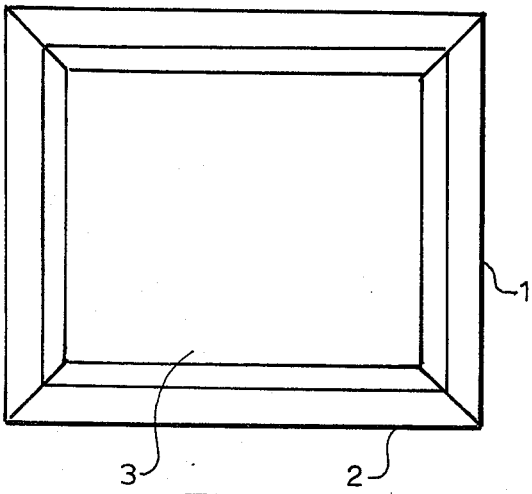
FIG. 1 is a front view illustrating the appearance of the present invention when the front decorative door is closed.
Figure 2:
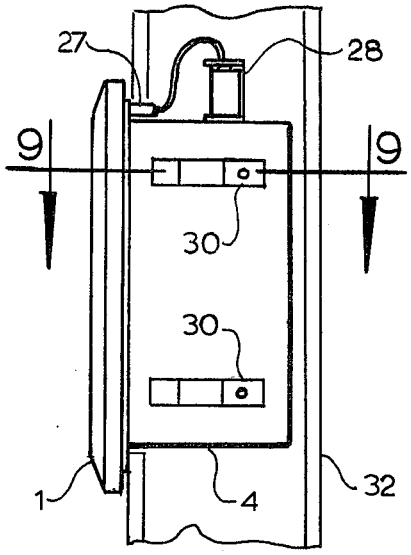
FIG. 2 is a side elevation view of the present invention shown with the front decorative door in a closed position.

With reference to the accompanying drawings, the preferred embodiment of the present invention, a gun cabinet, is shown in FIG. 1, a frontal view, as having the appearance of a framed work of art. The front door 1 of the present invention is constructed from an art work 3, mounted in a common type of picture frame 2. An alternative to the art work 3, which may be more suitable in some settings, is a document such as a license or certificate. It is apparent that a decorative wall mounting will effectively disguise the nature of the remaining portions of the gun cabinet, disposed directly behind said mounting. It is further apparent that a gun cabinet having such an appearance provides flexibility of location, thus making the contents therein more accessible to the user.

Immediately behind front door 1 is a steel housing 4, generally rectangular in shape and open at the front portion thereof. The external dimensions of housing 4 are such as to allow the placement of the present invention substantially within a recess in a wall 31 with only the front door 1 exposed to view. Front door 1 is rotatably mounted to an edge of housing 4 by a hinge 5. Magnetic strip 33, cemented to the rear side of door 1, retains door 1 in a closed position by the magnetic attraction to the metallic housing 4.

Figure 3:
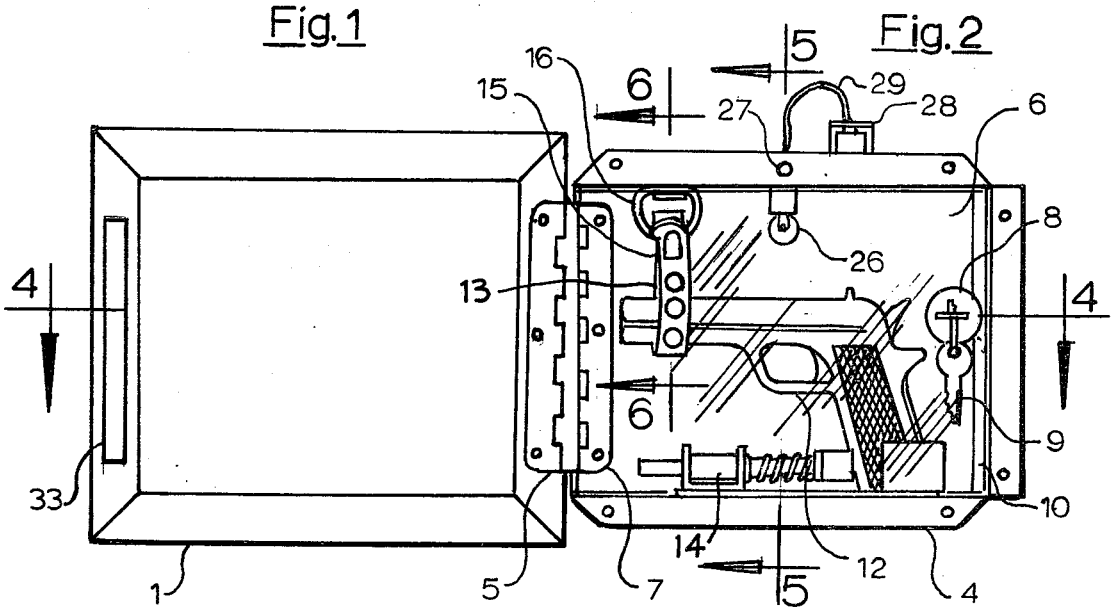
FIG. 3 is a front view illustrating the present invention with a gun in place and the front decorative door in an open position.
Figure 4:
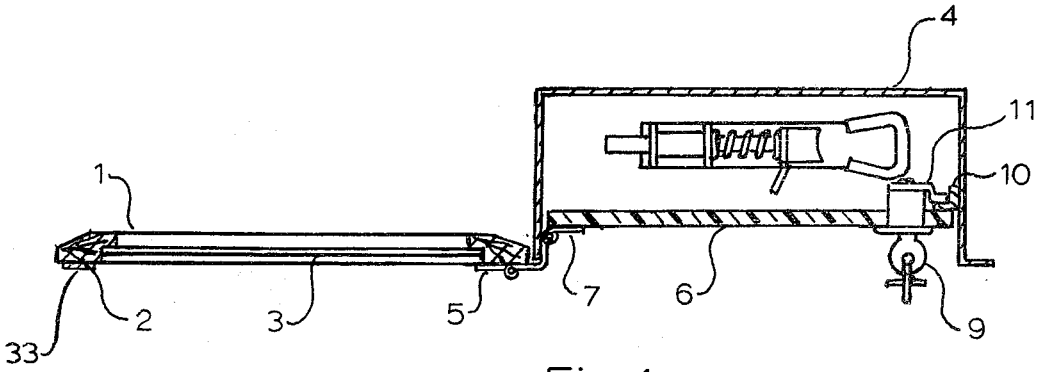
FIG. 4 is a sectional view taken in the direction of arrows 4—4 in FIG. 3 with the gun removed to illustrate features of the present invention.
Figure 5:
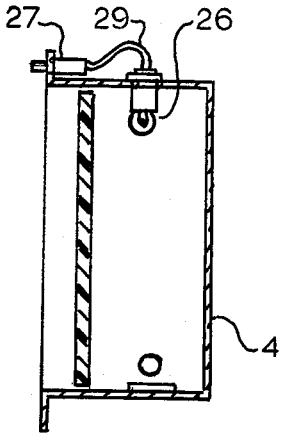
FIG. 5 is a sectional view taken in the direction of arrows 5—5 in FIG. 3.

The general arrangement of the contents of housing 4 is shown in FIG. 3 wherein the front door 1 is in an open position. At the forward portion of housing 4, extending across the opening thereof is an interior door 6 constructed from a transparent material such as acrylic plastic or DuPont Lexan. Optionally, door 6 may be constructed from a non transparent material such as steel. Door 6 is rotatably mounted to one side of housing 4 by a second hinge 7 and includes a lock assembly 8 at the other side thereof. The lock 8 which is operated by a key 9 extends through the thickness of the inner door 6. As shown in FIG. 4 the end portion of door 6 abuts an angle door stop 10 which is affixed to an inner surface of housing 4 and is secured in a locked condition by a lock pawl 11 which is a component of the lock assembly 8. The pawl 11 which is rotatable about the axis of the lock assembly 8 is urged to the locked and unlocked positions by rotation of the key 9. Hinges 5 and 7 are similar in construction and may optionally be separate assemblies or combined in a single unit.

The door 6 has been constructed from a transparent material to allow the user of the present invention to inspect or display the contents of housing 4 without the necessity of unlocking door 6. In the interior of housing 4 is an adjustable fixture for retention of a handgun 12. The adjustable fixture, which is believed to be novel by itself, comprises an adjustable stirrup 13, for supporting the barrel portion of the handgun 12, and a compression clamp 14 for retention of the handle portion of said handgun 12.

Figure 6:
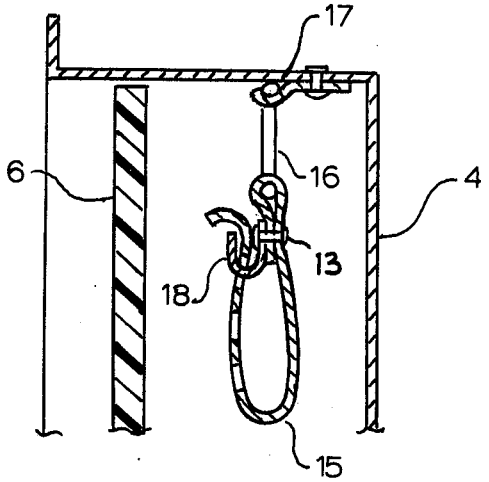
FIG. 6 is an enlarged partial sectional view taken in the direction of arrows 6—6 in FIG. 3.

The construction of stirrup 13 is shown in FIGS. 3 and 6 and comprises a strap 15 in a looped configuration having series of holes and a hook 18 affixed to said strap 15. For purposes of clarity, the handgun 12 has been shown only in FIG. 3. The strap 15 is supported by a ring 16 which is mounted to an interior surface of the housing 4 by a bracket 17. The hook 18, affixed to the upper portion of strap 15, extends through one of the aforesaid holes of strap 15, thereby maintaining a desired adjustment of stirrup 13. It is obvious that such a construction provides for a range of adjustments for accommodating height and length variations in handgun 12 designs. It is further obvious that the barrel of handgun 12 may be quickly engaged and disengaged from the stirrup 13.

Figure 7:
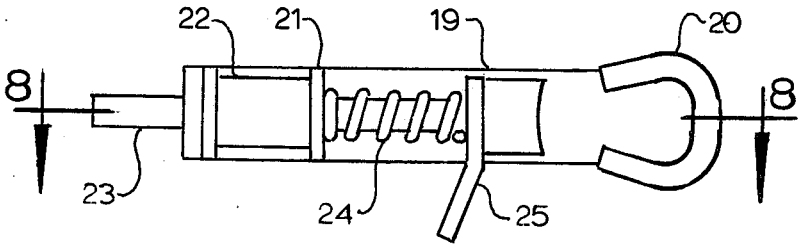
FIG. 7 is an enlarged plan view of the adjustable holding fixture of the present invention with no gun in place.
Figure 8:
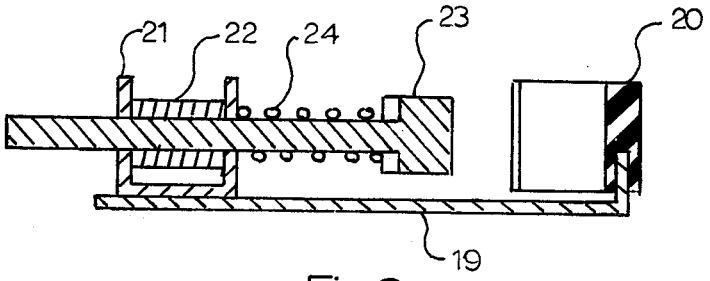
FIG. 8 is a sectional view taken in the direction of arrows 8—8 in FIG. 7.

The construction of the compression clamp 14 is best shown in FIGS. 7 and 8. A base bracket 19 is provided affixed interiorally to the bottom portion of housing 4. At one end portion of bracket 19 is a cradle 20 constructed of an elastomeric material such as rubber or flexible plastic. Cradle 20 is maintained in position by engagement with a vertical leg of bracket 19. At the other end portion of bracket 19 is a yoke type bracket 21 which is secured to the top surface of bracket 19. Bracket 21 supports a guide bushing 22 wherein a plunger 23 is slideably engaged. A helical compression spring 24, concentric with the said plunger 23, provides the necessary clamping force for retention of the handle portion of the handgun 12, while the flexible cradle 20 accommodates a range of handle styles and thicknesses. The lever 25 affixed to plunger 23 provides a convenient and quick means of releasing the handle portion of handgun 12. It is apparent that the novel construction of the disclosed holding fixture allows the quick release of handgun 12 in the event of an emergency.

An electric illumination system comprising a light and socket assembly 26, a switch 27, a battery and holder 28 and interconnecting wiring 29 enhances the display of the handgun 12 and assists the user in a quick removal of the handgun 12 in the event of an emergency. It will be appreciated that the illumination of the cabinet interior is of particular benefit during emergency removal of the handgun 12 during nighttime hours. The switch 27 is a commercially available normally closed plunger type switch assembly, mounted in an upper flange portion of housing 4. When the front door 1 of the present invention is in a closed position the interior surface of said outer door 1 depresses the plunger of switch 27 thereby opening the contacts of said switch 27 for the deactivating of light 26. The light and socket assembly 26 extend through the top portion of housing 4 whereby the said light 26 may illuminate the interior of housing 4. Externally mounted on the top portion of housing 4 is the battery and holder 28. Interconnecting wiring 29 electrically connect the switch 27, light 26 and battery 28.

Figure 10:
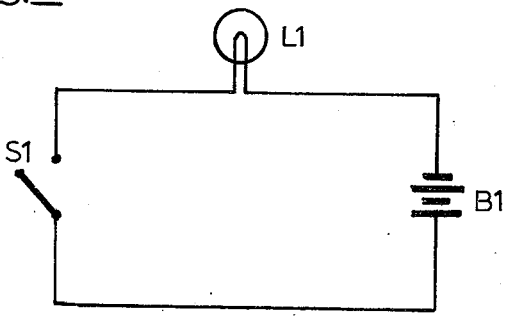
FIG. 10 is an electrical schematic diagram of circuitry used in the present invention.

FIG. 10 illustrates the electrical circuitry of the system. Power is supplied by the battery 28 designated as B1. Optionally, the electrical power supply of a building may be used. The contacts designated as S1 represent the contacts of switch 27 which is operable by physical contact with the front door 1. Light L1 is series connected to switch S1 and battery B1.

Figure 9:
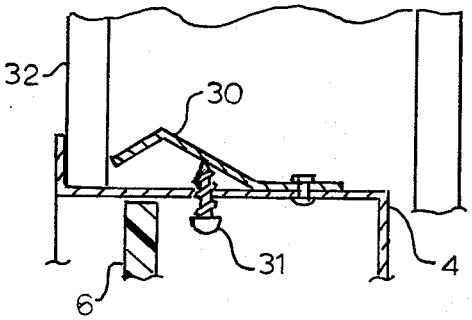
FIG. 9 is an enlarged sectional view taken in the direction of arrows 9—9 in FIG. 2.

A novel construction for retaining the present invention to a wall 32 is illustrated in FIG. 9 wherein a spring retainer 30 is displaced vertically upward by a screw 31 threadably engaged in the top portion of housing 4 after the said housing has been inserted into said wall 32.

While one specific embodiment of the present invention has been shown, it will be appreciated that other embodiments drawing from individual features of the shown embodiment can be provided. For example, a cabinet having similar features can be constructed for the storing of more than a single handgun.

Having now described my invention and the manner of making and using it, one can see that what has been accomplished is a gun cabinet for the secure storage of a handgun which provides quick access to said handgun in the event of an emergency, is attractive in appearance and allows location in a variety of settings.

What I claim is new is:

1. A cabinet having an outward appearance of a decorative wall article and adapted to be mounted substantially within the recess of a wall whereby a gun may be securely stored comprising: a generally rectangular shaped housing having an open forward portion thereof and dimensions such that said housing may be substantially contained within the recess of said wall; a holding fixture, adapted to accomodate a range of styles and sizes of guns, interiorly mounted to said housing for positioning and retaining a gun in a predetermined upright position within the housing; an outer door disposed directly in front of said housing having the outward appearance of a decorative wall article such as a framed work of art, said outer door being hinged at one end portion thereof to an end portion of said housing; a locking means for preventing unauthorized entry into said cabinet; and a means for retaining said cabinet to said wall.

2. The cabinet according to claim 1 wherein said means for retaining said cabinet to said wall comprises: a plurality of spring retainers, each of said retainers disposed exteriorally to said housing and affixed at one end thereof to a side of said housing; and a corresponding screw extending through said housing side directly behind said retainer, said screw being threadably engaged in said housing side such that when said screw by rotation is advanced outward from said side the other end of said retainer is urged to move outward from said housing.

3. A cabinet having an outward appearance of a decorative wall article and adapted to be mounted substantially within the recess of a wall whereby a gun may be securely stored comprising: a generally rectangular shaped housing having an open forward portion thereof and dimensions such that said housing may be substantially contained within the recess of said wall; a holding fixture, adapted to accomodate a range of styles and sizes of guns, interiorly mounted to said housing for positioning and retaining a gun in a predetermined upright position within the housing; an outer door disposed directly in front of said housing having the outward appearance of a decorative wall article such as a framed work of art, said outer door being hinged at one end portion thereof to an end portion of said housing; an inner door directly behind said outer door, hinged at one end thereof to one end portion of said housing and extending across the openining of said housing; a means for locking the other end portion of said inner door to the other end portion of said housing; and a means for retaining said cabinet to said wall.

4. The cabinet according to claim 3 wherein said inner door is constructed from a transparent material.

5. The cabinet according to claim 3 wherein said inner door is constructed from a non transparent material.

6. The cabinet according to claim 3 wherein said means for locking said inner door comprises: a channel door stop directly behind said locking end portion of said inner door; a lock assembly extending through said end portion of said door; a key for operating said lock; and a pawl rotatably affixed to an end portion of said lock assembly and rotatably operated by said key so as to engage an inner portion of said door stop to prevent the opening of said inner door.

7. A cabinet having an outward appearance of a decorative wall article whereby a gun may be securely stored comprising: a housing having an open forward portion thereof; a holding fixture, adapted to accomodate a range of styles and sizes of guns, interiorly mounted to said housing for positioning and retaining a gun in a predetermined upright position within the housing; an outer door having the outward appearance of a decorative wall article, said outer door being hinged at one end portion thereof to an end portion of said housing; means for illuminating the interior of said housing when said outer door is opened; and means for retaining said cabinet to a wall.

8. The cabinet according to claim 7 wherein said means for illuminating the interior of said cabinet when said outer door is opened comprises: a normally open electrical switch operable by said outer door and affixed to the end portion of said housing opposite said hinged portion; an electrical light affixed interiorly to said housing; an electrical power means for energizing said light; and electrical wiring for interconnecting said switch, light and source in series whereby when said outer door is opened the interior of said cabinet is illuminated by said light.

9. The cabinet according to claim 8 wherein said electrical power means for energizing said light is a battery.

10. The cabinet according to claim 8 wherein said power means for energizing said light is the power supply of a building.

11. A cabinet having the outward appearance of a decorative wall article whereby a gun may be securely stored comprising: a housing having an open forward potion thereof; a means for positioning and retaining a gun within the housing which comprises a stirrup affixed to an upper portion of said housing having an adjustable strap which is configured in the shape of a loop with a plurality of holes through one end portion of said strap and a hook type member affixed to the other end portion of said strap whereby when said hook member is engaged with one of said holes said stirrup may be used to retain the barrel of a gun, and a clamp member affixed to a lower portion of said housing having a flexible cradle at one end of said clamp member and an opposing spring loaded plunger at the other end thereof whereby said clamp member may be used to retain the handle of said gun; an outer door having the outward appearance of a decorative wall article, said outer door being hinged at one end portion thereof to an end portion of said housing; and a means for retaining said cabinet to a wall.

* * * * *